US007559616B2

(12) United States Patent
Kuki et al.

(10) Patent No.: US 7,559,616 B2
(45) Date of Patent: Jul. 14, 2009

(54) PRINTER

(75) Inventors: Masakazu Kuki, Ichinomiya (JP); Yasuhiko Kawaguchi, Nagoya (JP); Noriko Kawabe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 314 days.

(21) Appl. No.: 11/363,167

(22) Filed: Feb. 28, 2006

(65) Prior Publication Data

US 2006/0192798 A1 Aug. 31, 2006

(30) Foreign Application Priority Data

Feb. 28, 2005 (JP) ..... 2005-054248

(51) Int. Cl.
*B41J 25/308* (2006.01)

(52) U.S. Cl. ..... 347/8; 347/19; 347/37

(58) Field of Classification Search ..... None
See application file for complete search history.

(56) References Cited

U.S. PATENT DOCUMENTS 5,872,579 A * 2/1999 Handa et al. ..... 347/8
5,980,132 A * 11/1999 Kawai ..... 400/56
2002/0167563 A1* 11/2002 Sawyer et al. ..... 347/30
2007/0182779 A1* 8/2007 Iwasaki ..... 347/30

FOREIGN PATENT DOCUMENTS

JP A 05-084887 4/1993

* cited by examiner

*Primary Examiner*—Luu Matthew
*Assistant Examiner*—Justin Seo
(74) *Attorney, Agent, or Firm*—Oliff & Berridge, PLC

(57) ABSTRACT

A printer for printing a pattern, design, etc. on fabric comprises a vertical driving unit and a fabric thickness detecting mechanism. The vertical driving unit moves a printing unit including a print head in the vertical direction to let the print head move toward and away from the fabric held by a fabric holding frame. The fabric thickness detecting mechanism includes an idle roller which is attached to the printing unit to be on the preceding side of the printing unit in the printing direction of the print head to rotate freely while contacting the print surface of the fabric. The fabric thickness detecting mechanism detects the height of the print surface of the fabric based on the position of the idle roller. The vertical driving unit is controlled to drive the printing unit vertically according to the height of the print surface detected by the fabric thickness detecting mechanism.

13 Claims, 14 Drawing Sheets

PRINTER

CROSS-REFERENCE TO RELATED APPLICATION

This application is related to Japanese Patent Application No. 2005-054248, filed on Feb. 28, 2005, the entire subject matter of which is incorporated herein by reference.

BACKGROUND

1. Technical Field

Aspects of the present invention relate to a printer for executing inkjet printing on fabric held by a fabric holding frame.

2. Description of Related Art

A variety of printing techniques have been proposed for printing desired patterns, designs, etc. on various types of fabrics, and a variety of inkjet printing devices, capable of printing desired patterns, designs, etc. on the surface of fabric by moving the fabric or a print head relative to each other in an X direction and a Y direction (orthogonal to the X direction) while letting ink nozzles discharge color ink onto the fabric according to print data, have been proposed.

For example, in a printer described in Japanese Patent Provisional Publication No. HEI 05-84887 (hereinafter referred to as '887 publication), an X-movement bar is held to be movable in a direction along grooves formed on both lateral faces of a machine frame which is formed in a U-shape in the plan view, an X-movement arm is supported by the X-movement bar to be movable along the X-movement bar, a printing unit is attached to the end of the X-movement arm, and a fabric holding frame holding fabric to be printed on is mounted on a table which is placed at the center of the machine frame. In the printer, the distance between the top of the machine frame and an attaching portion attaching the fabric holding frame to the machine frame (fabric thickness) is detected by a fabric thickness sensor provided at the top of the machine frame, and the height of the table is changed, using a motor, depending on the detected fabric thickness.

In the printing unit of the printer, a plurality of ink heads are supported by a head supporting member to face downward, and the height of the head supporting member is changed by a head motor while detecting the height of the ink heads from (relative to) the surface of the fabric by use of a noncontact optical sensor placed in the vicinity of the ink heads. When the printing is started, the height of the ink heads is set to be a prescribed height higher than the surface of the fabric based on the fabric thickness detected by the fabric thickness sensor. Meanwhile, when the detected fabric thickness changes due to small pieces of fabric (applique, etc.) sewn on the fabric, the height of the ink heads is changed by activating the head motor so as to keep a constant height of the ink heads from the surface of the fabric.

In the printer disclosed in the '887 publication, the printing unit is provided with the noncontact optical sensor placed in the vicinity of the ink heads in order to detect the height of the ink heads from the surface of the fabric (i.e. head gap). In this configuration, ink mist discharged from the ink heads during printing adheres to the noncontact optical sensor and when a photoreceptor unit or a photoemitter unit is smeared with the ink mist, the distance to the surface of the fabric can not be detected precisely and the head gap can not be set correctly.

Also when the fabric has frayed parts, fuzzy parts, lint, embroidery, etc. thereon, the distance to the surface of the fabric can not be detected precisely and the head gap can not be set correctly. Further, the head gap can not be set correctly also when reflecting conditions (e.g. reflectance) of light emitted by the photoemitter unit vary depending on the material or color of the fabric.

SUMMARY

Aspects of the present invention which has been made in consideration of the above problems are advantageous in that a printer, capable of executing inkjet printing on fabric finely and precisely by correctly detecting the height of the surface of the fabric and constantly keeping the head gap at a proper distance even when there are concavities/convexities on the surface of the fabric and irrespective of the material and color of the fabric, can be provided.

BRIEF DESCRIPTION OF THE ACCOMPANYING DRAWINGS

The objects and features of the present invention will become more apparent from the consideration of the following detailed description taken in conjunction with the accompanying drawings.

DETAILED DESCRIPTION

General Overview

Figure 1:
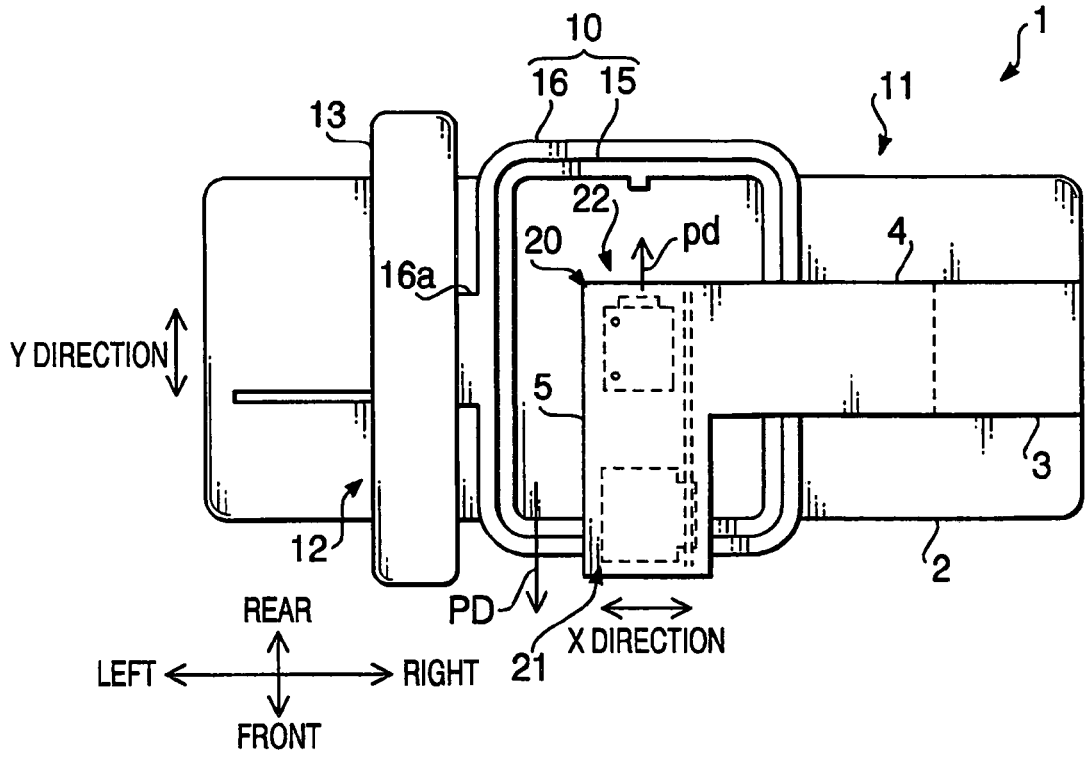
FIG. 1 is a plan view of a printer in accordance with aspects of an illustrative embodiment of the present invention.

In accordance with aspects of the present invention, there is provided a printer comprising: an inkjet head; a head supporting body which supports the inkjet head; a moving unit which moves the head supporting body or a fabric holding body (holding fabric to be printed on by the inkjet head) relative to each other in two orthogonal directions; a supporting body moving unit which moves the head supporting body so as to let the inkjet head move toward and away from the fabric; a fabric thickness detecting unit which includes a contactor (being attached to the head supporting body to be placed on a preceding side of the head supporting body in a printing direction of the inkjet head and making contact with a print surface of the fabric held by the fabric holding body) and detects height of the print surface of the fabric based on the position of the contactor; and a drive control unit which executes drive control of the supporting body moving unit according to the height of the print surface of the fabric detected by the fabric thickness detecting unit.

In the printer configured as above, the contactor (making contact with the print surface of the fabric) is attached to the head supporting body to be placed on the preceding side of the head supporting body in the printing direction, and thus the height of the print surface of the fabric (fabric thickness) corresponding to the position of the contactor is detected by the fabric thickness detecting unit including the contactor preceding the movement of the head supporting body moved by the moving unit in the printing direction. The drive control of the supporting body moving unit is executed by the drive control unit according to the height of the print surface of the fabric detected by the fabric thickness detecting unit.

Since the height of the print surface of the fabric (corresponding to the position of the contactor) can be detected by the fabric thickness detecting unit of the so-called contact type (including the contactor making contact with the print surface of the fabric) and the height of the supporting body moving unit can be controlled and adjusted according to the detected height of the print surface of the fabric, a desired pattern, design, etc. can be printed on the fabric finely and precisely by constantly keeping a head gap (between the inkjet head and the print surface of the fabric) at a prescribed distance even when the fabric has frayed parts, fuzzy parts or lint thereon and irrespective of the material and color of the fabric.

Since the fabric thickness detecting unit employs no optical sensor for the detection of the fabric thickness, the fabric thickness detecting unit can be prepared at a low price. Further, the fabric thickness detecting unit, free from ill effects of ink mist during printing, is capable of correctly detecting the height of the print surface of the fabric, realizing high reliability of the head gap setting.

Since the contactor is attached to the head supporting body to be placed on the preceding side of the head supporting body in the printing direction, the contactor is prevented from being smeared with the ink printed on the fabric, by which ink stains on the fabric, that can be caused by the contact with the contactor, can be eliminated securely.

Preferably, the width of a contact face of the contactor making contact with the fabric is set equal to the print width of nozzle arrays of the inkjet head.

In the printer configured as above, any convex portion of the fabric within the print width can be detected with reliability.

The width of the contact face of the contactor making contact with the fabric may also be set smaller than the print width of the nozzle arrays of the inkjet head.

In the printer configured as above, the contactor is prevented from being smeared with ink that has been printed on the fabric in the previous print cycle even when overlapped printing (in which the print width in a print cycle overlaps with that in the previous print cycle) is executed, by which ink stains on the fabric, that can be caused by the contact with the contactor, can be eliminated with reliability.

Preferably, the contactor is implemented by an idle roller which is rotatable around a horizontal axis orthogonal to the printing direction.

In the printer configured as above, even when the fabric has embroidery, needlework, applique, etc. thereon and the height of the print surface of the fabric changes during the printing while feeding the fabric (that is, even when there are obstacles such as gaps and level differences), the contactor (idle roller) can easily climb over any obstacle while rotating around the horizontal axis, by which the height of the print surface of the fabric can be detected correctly and reliably.

Preferably, the fabric thickness detecting unit includes: a sensor shaft being vertically movable relative to the head supporting body and having the contactor at one end; an elastic body which biases the sensor shaft toward the fabric; and a displacement detecting unit which detects displacement of the sensor shaft moving upward against the biasing force of the elastic body.

In the printer configured as above, the fabric thickness detecting unit can be manufactured at a low price while realizing compact design and weight reduction.

The displacement detecting unit may be implemented by a potentiometer, for example.

Preferably, the printer further comprises: a receiver tub member which receives ink during flushing of the inkjet head; and a covering member capable of covering the top of the receiver tub member.

In the printer configured as above, the ink discharged from the inkjet head for the flushing can be received by the receiver tub member and collected therein, and it is possible to let the covering member cover the top of the receiver tub member and block the contactor from falling into the receiver tub member even when the contactor passes over the receiver tub member, by which the contactor is securely prevented from being smeared with ink.

Preferably, the printer further comprises an ink-absorbing member which is placed on an inner surface of the receiver tub member.

In the printer configured as above, the ink discharged from the inkjet head for the flushing can securely be received by the receiver tub member and collected therein without letting off the received ink.

Preferably, the covering member is placed at an uncovering position for letting the top of the receiver tub member be open when the flushing of the inkjet head is executed, while being placed at a covering position for covering the top of the receiver tub member when purging of the inkjet head is executed.

In the printer configured as above, when the flushing (discharging ink from ink nozzles onto the receiver tub member) is executed, the covering member is necessarily placed at the uncovering position away from the top of the receiver tub member. Therefore, the flushing process can be carried out without smearing the covering member with ink discharged by the inkjet head for the flushing.

Preferably, the printer further comprises: a maintenance unit linked with the covering member and including a purge mechanism executing the purging of the inkjet head; a biasing member which biases the covering member toward the uncovering position; and a contact member which makes contact with an end of the covering member as the maintenance unit is moved toward a position for the purging of the inkjet head and thereby pushes the covering member toward the covering position against the biasing force of the biasing unit.

In the printer configured as above, the covering member which is constantly biased toward the uncovering position by the biasing member makes contact with the contact member as the maintenance unit (linked with the covering member) is moved toward the position for the purging. As the maintenance unit is moved further toward the position for the purging, the covering member is pushed toward the covering position against the biasing force of the biasing unit. With the configuration, the covering member can be switched between the uncovering position and the covering position automatically.

Preferably, the contactor of the fabric thickness detecting unit is placed on the covering member when the purging of the inkjet head is executed.

In the printer configured as above, the contactor is blocked from falling into and getting stuck in the receiver tub member in the purging of the inkjet head, by which the contactor is securely prevented from being smeared with ink.

Preferably, a slant guide surface for guiding the contactor is formed at an end of the covering member.

In the printer configured as above, even when the covering member has a height greater than that of the contactor, the contactor, guided by the slant guide surface, can easily climb up to the top of the covering member without fail.

Preferably, the printer further comprises a maintenance unit which includes a purge mechanism executing the purging of the inkjet head. The maintenance unit is configured to be switchable between a standby position to the rear of the head supporting body in the printing direction and a maintenance position under the head supporting body which has been switched to an upper position. The receiver tub member and the covering member are fixed to the maintenance unit to be placed on the preceding side of the maintenance unit in the printing direction.

In the printer configured as above, the maintenance unit placed at the standby position during the printing by the inkjet head can move to the maintenance position under the head supporting body switched to the upper position in cases of maintenance (e.g. purging) and thereby execute a variety of maintenance such as the purge process and a cap process.

When the maintenance unit is placed at the maintenance position as above, the receiver tub member fixed to the maintenance unit is covered by the covering member, by which the contactor supported by the head supporting body is securely prevented from falling into and getting stuck in the receiver tub member.

Incidentally, the drive control unit may be configured to execute the drive control of the supporting body moving unit according to the height of the print surface of the fabric detected by the fabric thickness detecting unit a prescribed time period before the drive control.

Preferably, the prescribed time period is determined according to speed of movement of the fabric holding frame relative to the contactor of the fabric thickness detecting unit in the printing direction.

In the printer configured as above, the head gap setting can correctly be executed with high reliability even when the contactor of the fabric thickness detecting unit and the inkjet head are far from each other in the printing direction.

EMBODIMENT

Referring now to the drawings, a description will be given in detail of a preferred embodiment in accordance with the present invention.

Figure 2:
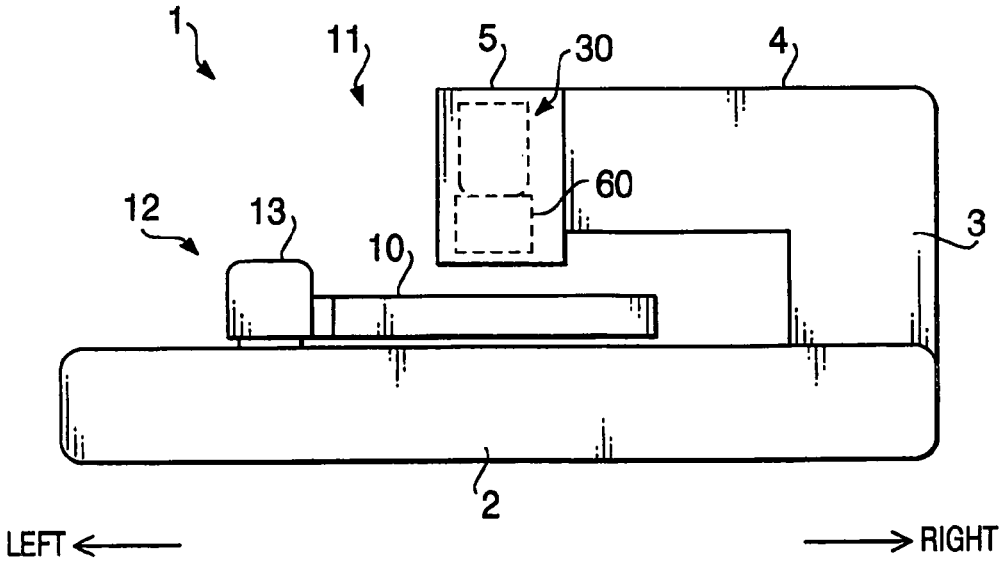
FIG. 2 is a front view of the printer according to aspects of the invention.

FIG. 1 is a plan view of a printer 1 in accordance with an embodiment of the present invention. FIG. 2 is a front view of the printer 1. The printer 1 shown in FIGS. 1 and 2 is an inkjet printer for printing a desired pattern, design, etc. on fabric held by a fabric holding frame by discharging color ink from an inkjet head. In the printer 1, an idle roller, rotating freely while making contact with the surface (print surface) of the fabric, is installed in a printing mechanism to be movable in the vertical direction, and the vertical position of the idle roller is detected by a fabric thickness detecting mechanism installed in the printing mechanism.

As shown in FIGS. 1 and 2, the printer 1 includes a main body 11 and a frame driving mechanism 12. The main body 11 includes a printing mechanism 20, a maintenance mechanism 21 and a fabric thickness detecting mechanism 22. The printing mechanism 20 includes a fabric holding frame 10 for holding fabric W detachably and an inkjet head 36 (hereinafter simply referred to as a "print head 36") for executing inkjet printing on the fabric W held by the fabric holding frame 10. The maintenance mechanism 21 maintains the print head 36 in fine condition suitable for printing. The fabric thickness detecting mechanism 22 detects the thickness of the fabric W held by the fabric holding frame 10. Meanwhile, the frame driving mechanism 12 is a mechanism for driving the fabric holding frame 10 in an X direction and in a Y direction (orthogonal to the X direction) independently in order to move the printing position of the print head 36 on the fabric W in the two orthogonal directions (X and Y directions) independently.

Figure 3:
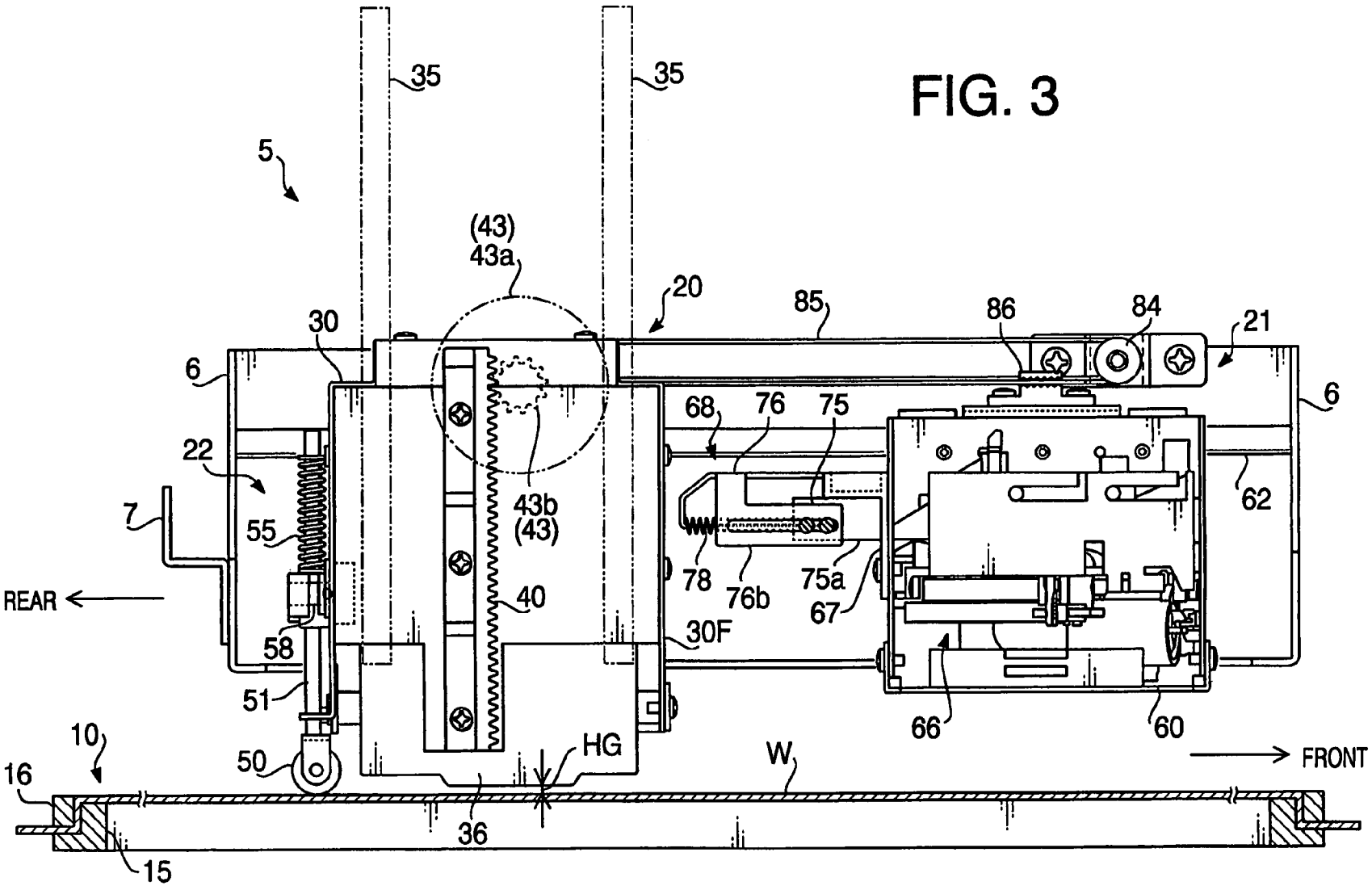
FIG. 3 is a left side view of a main body of the printer according to aspects of the invention.

FIG. 3 is a left side view of the main body 11 of the printer 1. As shown in FIGS. 1 and 3, the fabric holding frame 10 includes an inner frame 15 and an outer frame 16 for sandwiching and holding the fabric W. Since backing material (unshown) has previously been stuck on the back (underside) of the fabric W, the fabric W is set and held in the fabric holding frame 10 in a flat and strained state. The outer frame 16 has a connecting portion 16*a* formed integrally therewith. The connecting portion 16*a* of the outer frame 16 is detachably attached to a Y carriage 13 of the frame driving mechanism 12. Incidentally, while the fabric holding frame 10 in this embodiment is in a rectangular shape, the fabric holding frame 10 may of course be formed in various shapes (elliptical shape, circular shape, etc.).

As shown in FIG. 2, the main body 11 includes a bed portion 2, a pillar 3 and an arm portion 4. The frame driving mechanism 12 is installed in the bed portion 2. As shown in FIGS. 1 and 2, a mechanism installation portion 5 is formed at an end of the arm portion 4 to protrude frontward (to form an L-shape). The printing mechanism 20 and the maintenance mechanism 21 are installed in the mechanism installation portion 5.

The printing mechanism 20 is installed in a rear portion of the mechanism installation portion 5 to be movable upward and downward. Meanwhile, the maintenance mechanism 21 is installed in a front portion of the mechanism installation portion 5 to be movable frontward and rearward between a standby position (at the front end of the mechanism installation portion 5) and a maintenance position (at the rear end of the mechanism installation portion 5 and under the printing mechanism 20). In FIG. 1, the direction of movement of the fabric holding frame 10 holding the fabric W during the printing is indicated by an arrow "PD" (pointing frontward), while the direction of the printing by the printing mechanism 20 on the fabric W is indicated by an arrow "pd" (pointing rearward).

While the fabric holding frame 10 is movable rightward/leftward (in the X direction) and frontward/rearward (in the Y direction) as shown in FIG. 1 by the driving force of the frame driving mechanism 12, the printing on the fabric W by the print head 36 discharging ink is executed only when the fabric holding frame 10 is being moved in the frontward direction indicated by the arrow "PD". Therefore, the direction of the printing on the fabric W by the print head 36 is the rearward direction indicated by the arrow "pd".

After the printing of one cycle (one line) is finished, the fabric holding frame 10 is moved rearward (reversely to the arrow "PD") to a rearmost position while shifting it rightward or leftward (in the X direction) with no discharging of ink from the print head 36 (to prepare for the printing of the next cycle) and thereafter the printing of the next cycle (next line) is executed while moving the fabric holding frame 10 frontward (in the direction of the arrow "PD"). The above cycle is repeated to cover the whole printing range, by which a desired pattern, design, etc. is printed on the fabric W.

Although not shown in the figures, the front face of the pillar 3 is provided with a display (for displaying various setting screens and letting the user select a pattern, design, etc. to be printed on the fabric W), various switches, various indicator lamps for indicating setting statuses, etc.

Figure 13:
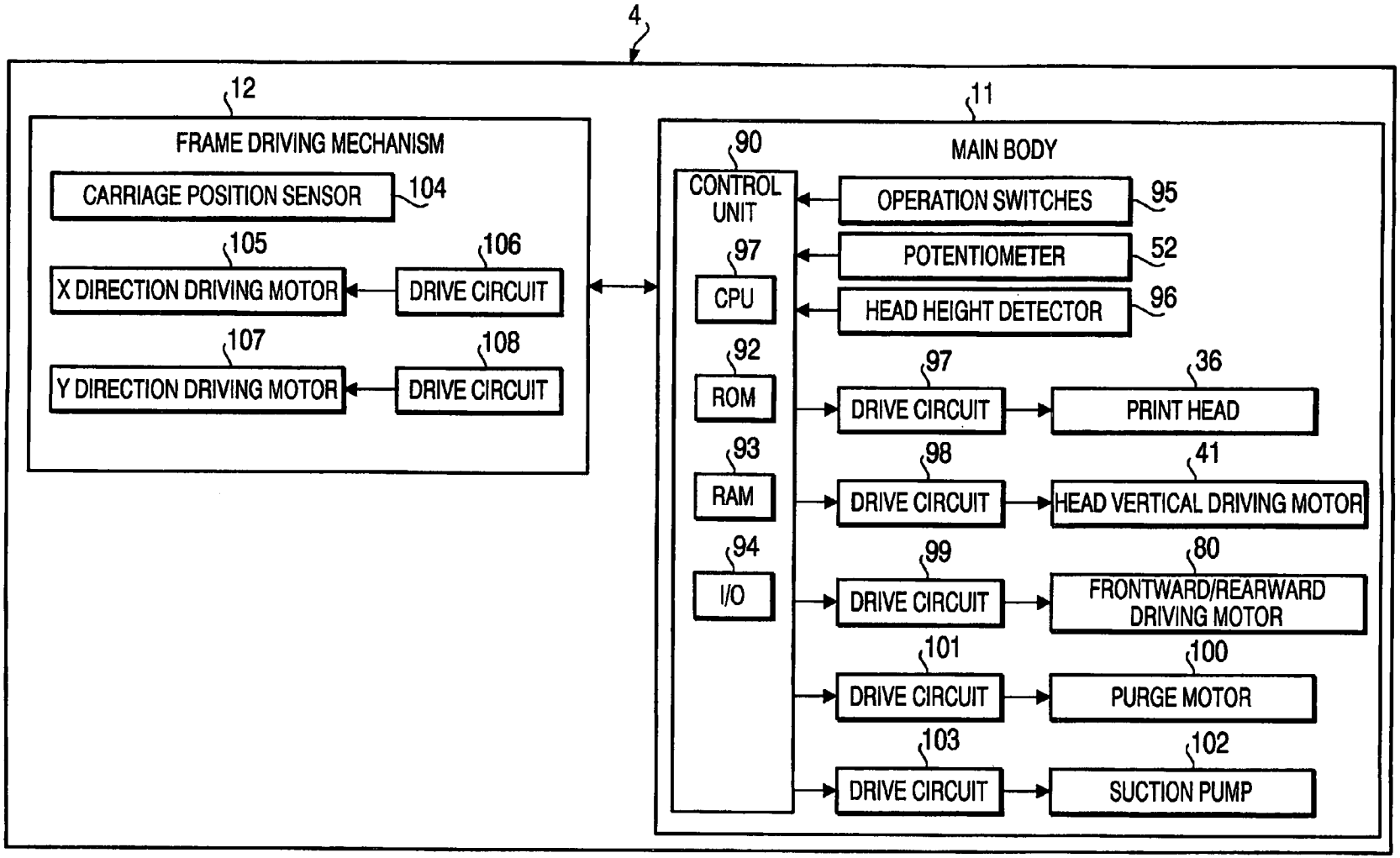
FIG. 13 is a block diagram of a control system of the printer according to aspects of the invention.

The frame driving mechanism 12 includes a Y direction driving unit (unshown) for driving the Y carriage 13 (provided on the bed portion 2 and joined to the fabric holding frame 10) in the Y direction (frontward/rearward) by use of its Y direction driving motor 107 (see FIG. 13) and an X direction driving unit (unshown) embedded in the bed portion 2 for driving the Y carriage 13 in the X direction (rightward/leftward) by use of its X direction driving motor 105 (see FIG. 13).

Figure 4:
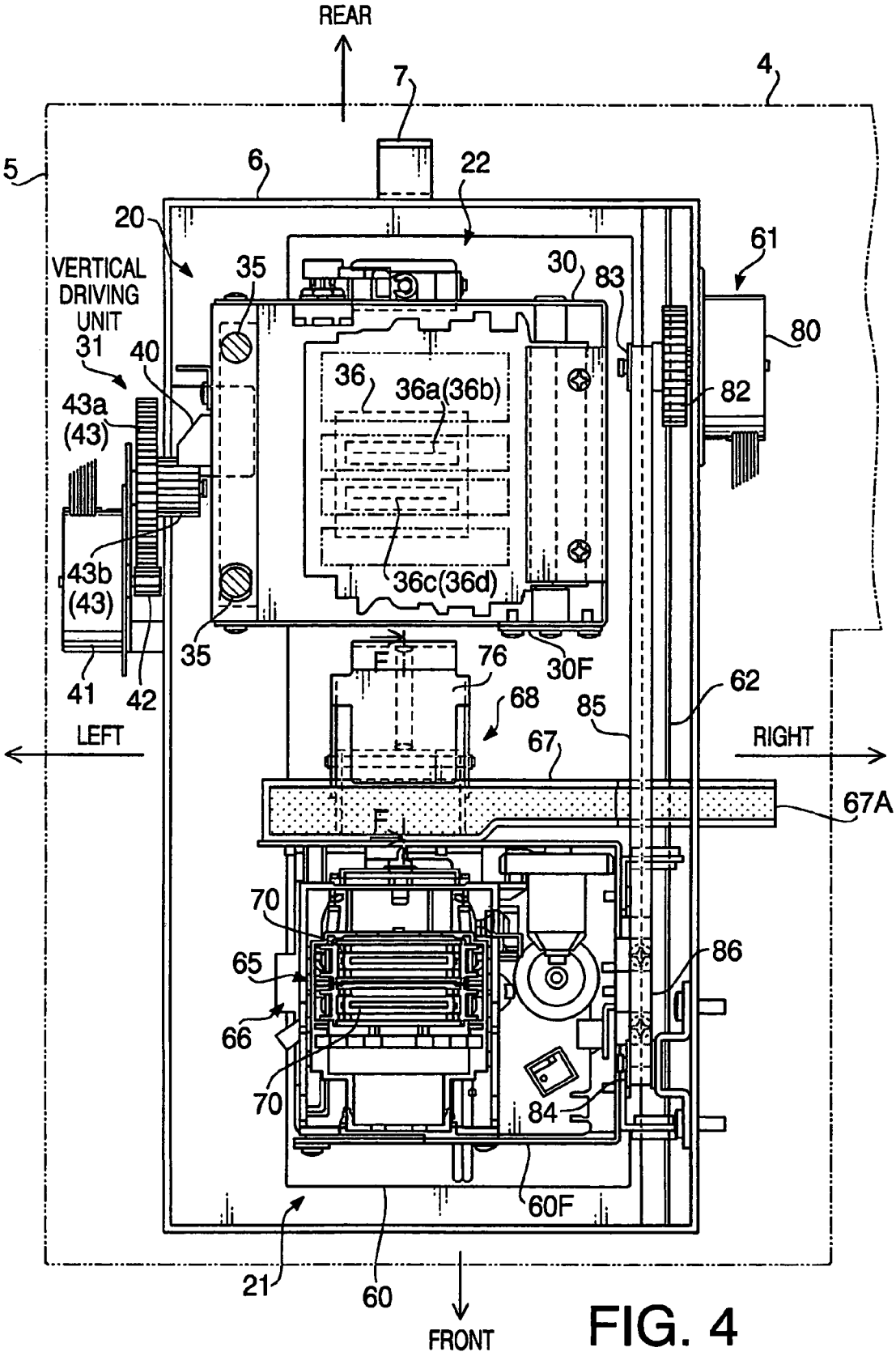
FIG. 4 is a plan view of the main body according to aspects of the invention.
Figure 5:
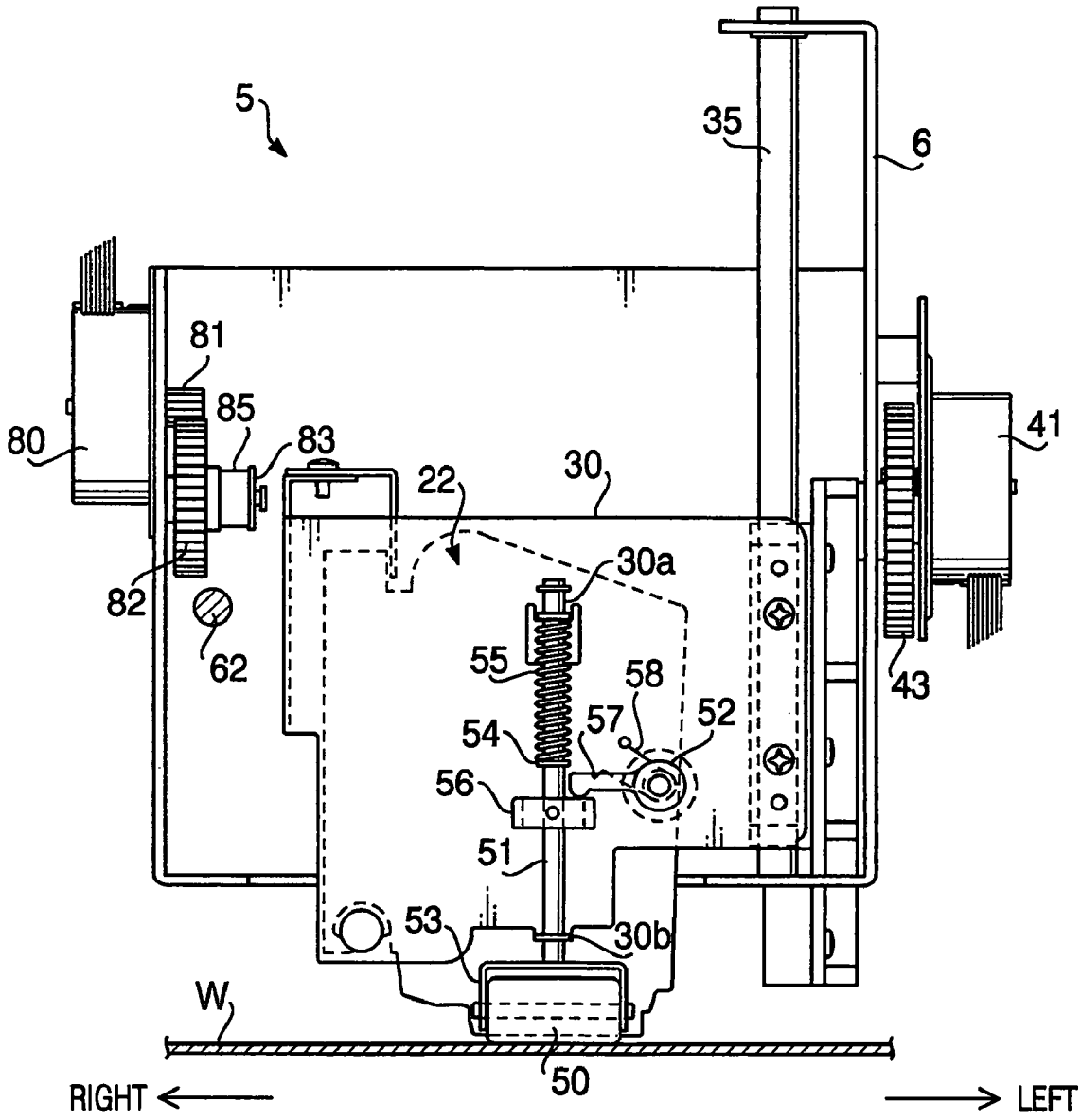
FIG. 5 is a rear view of the main body according to aspects of the invention.

Next, the printing mechanism 20 installed in the mechanism installation portion 5 will be explained in detail referring to FIGS. 3-5. FIG. 3 is a left side view of the main body 11 of the printer 1 as mentioned above. FIG. 4 is a plan view of the main body 11. FIG. 5 is a rear view of the main body 11. The mechanism installation portion 5 includes a chassis 6 like a rectangular frame, and the printing mechanism 20 is mounted on the rear portion of the chassis 6. As shown in FIG. 4, the printing mechanism 20 includes a printing unit 30 (having the print head 36) and a vertical driving unit 31 for driving the printing unit 30 vertically (moving the printing unit 30 toward and away from the fabric W).

First, the printing unit 30 formed in a box shape will be explained. As shown in FIG. 4, in a rear left portion of the chassis 6, a pair of head guide shafts 35 extending vertically are placed front and back with their upper and lower ends fixed to the chassis 6. A unit frame 30F of the printing unit 30 is supported by the pair of head guide shafts 35 at its left end to be movable vertically. The printing unit 30 is implemented by an inkjet printing unit.

Inside the printing unit 30, the print head 36 (inkjet head) is placed to face downward, and although not shown in the figures, four ink cartridges for storing inks of four colors (cyan, magenta, yellow and black) and ink supply tubes for connecting the ink cartridges with the print head 36 are accommodated above the print head 36.

The print head 36 includes four nozzle arrays 36*a*-36*d* for the four colors, in which the nozzle arrays 36*a* and 36*b* adjacent to each other are formed as a rear nozzle unit and the nozzle arrays 36*c* and 36*d* adjacent to each other are formed as a front nozzle unit. Each nozzle array 36*a*-36*d* includes a lot of nozzles, by which a print width of approximately 1 inch is covered. According to print instructions supplied from a control unit 90 which will be explained later, piezoelectric ceramic actuators in the print head 36 are bent and the inks of the four colors are selectively discharged from the four nozzle arrays 36*a*-36*d* toward the fabric W placed under the print head 36.

Next, the vertical driving unit 31 for driving the printing unit 30 vertically will be explained. As shown in FIGS. 3-5, a rack member 40 extending vertically is fixed on the left side face of the unit frame 30F of the printing unit 30 with a plurality of screws. Meanwhile, on a portion of the chassis 6 corresponding to the left side face of the unit frame 30F, a head vertical driving motor 41 is fixed and a double gear 43 having a large-diameter gear 43*a* (for engaging with a drive gear 42 fixed on the drive shaft of the head vertical driving motor 41) is supported to be rotatable. A small-diameter gear 43*b* of the double gear 43 engages with the cogs of the rack member 40 of the printing unit 30.

Figure 7:
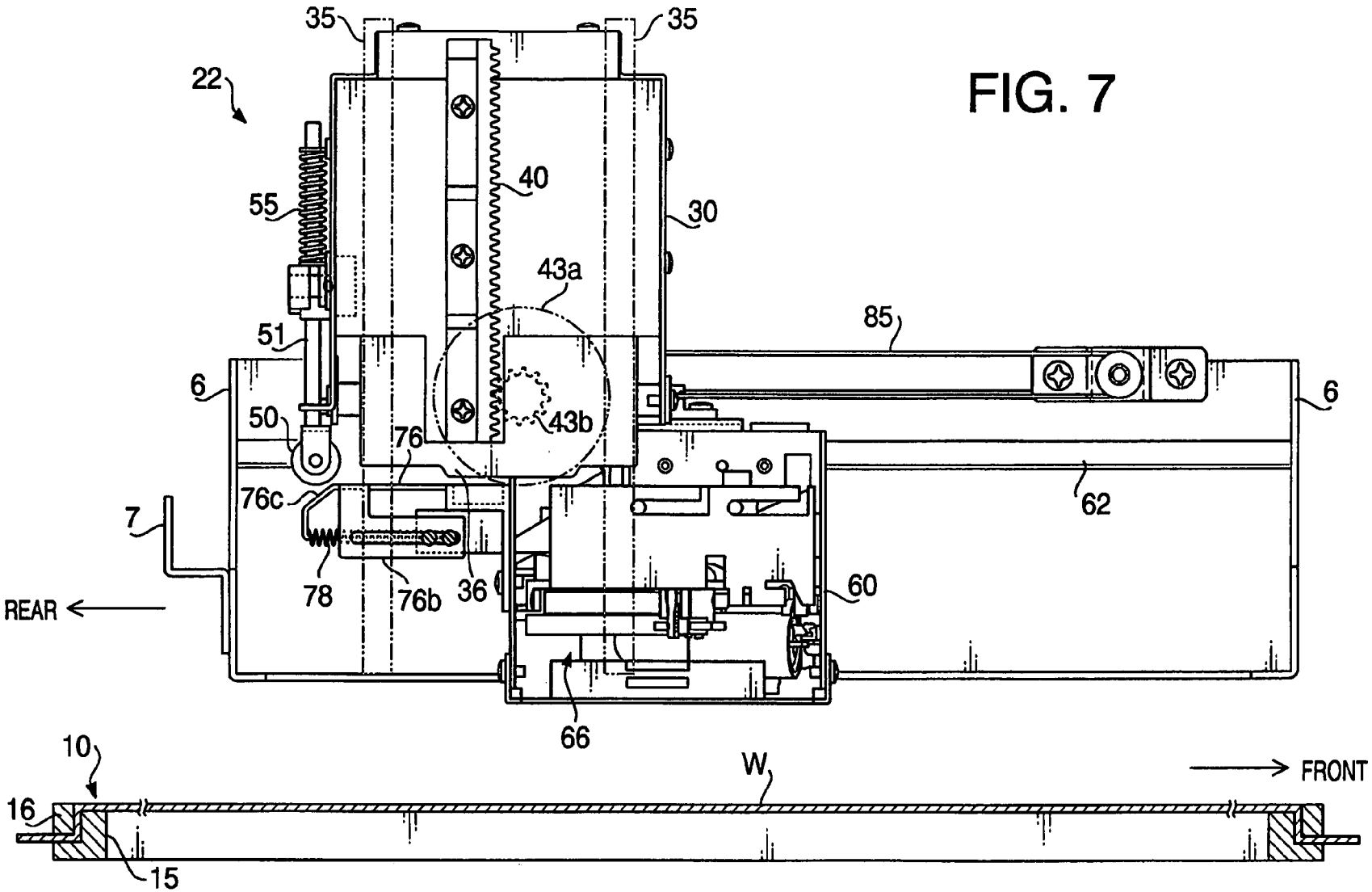
FIG. 7 is a left side view of the main body (corresponding to FIG. 3) during a flushing process according to aspects of the invention.
Figure 8:
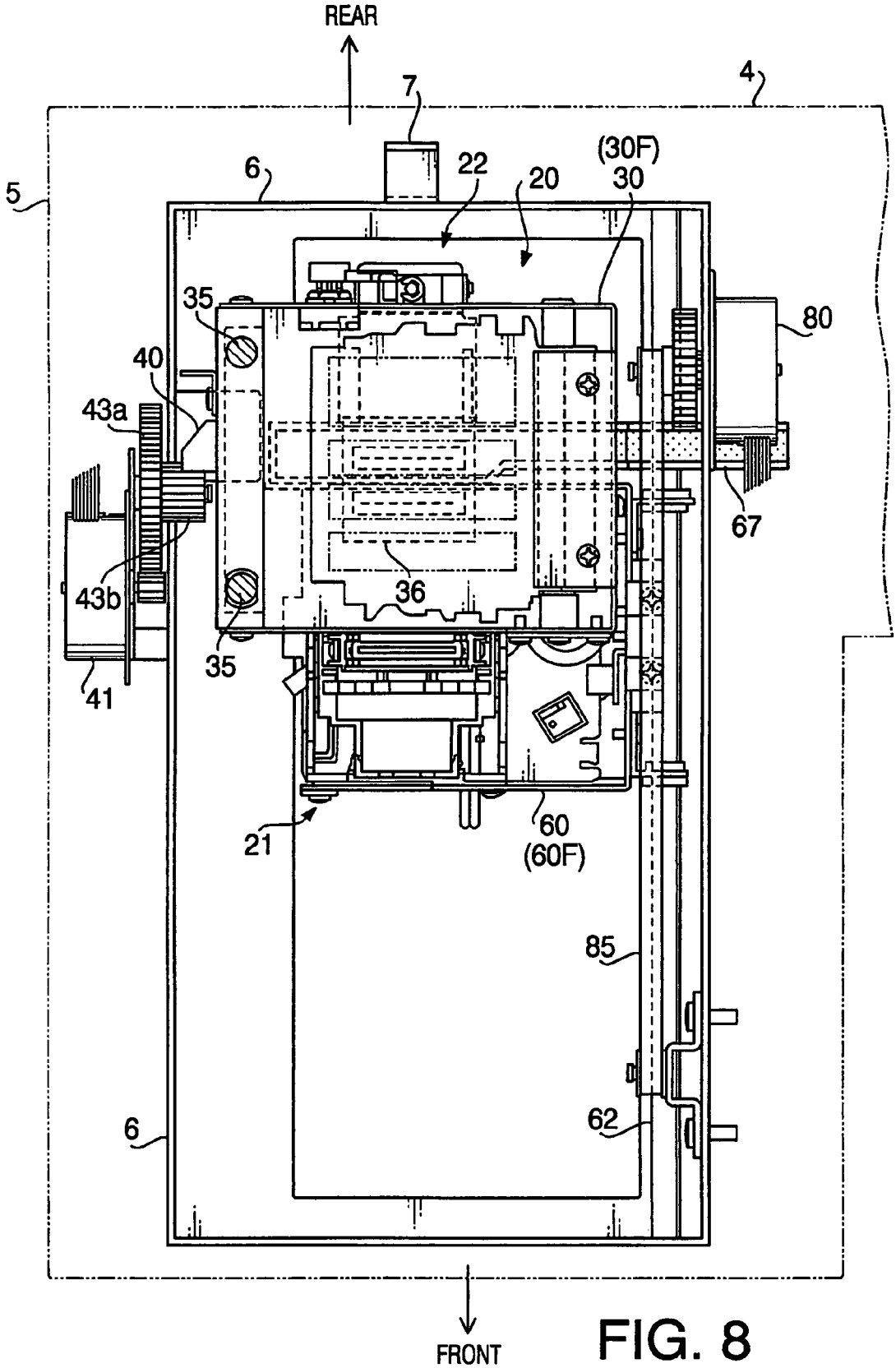
FIG. 8 is a plan view of the main body (corresponding to FIG. 4) during the flushing process according to aspects of the invention.
Figure 9:
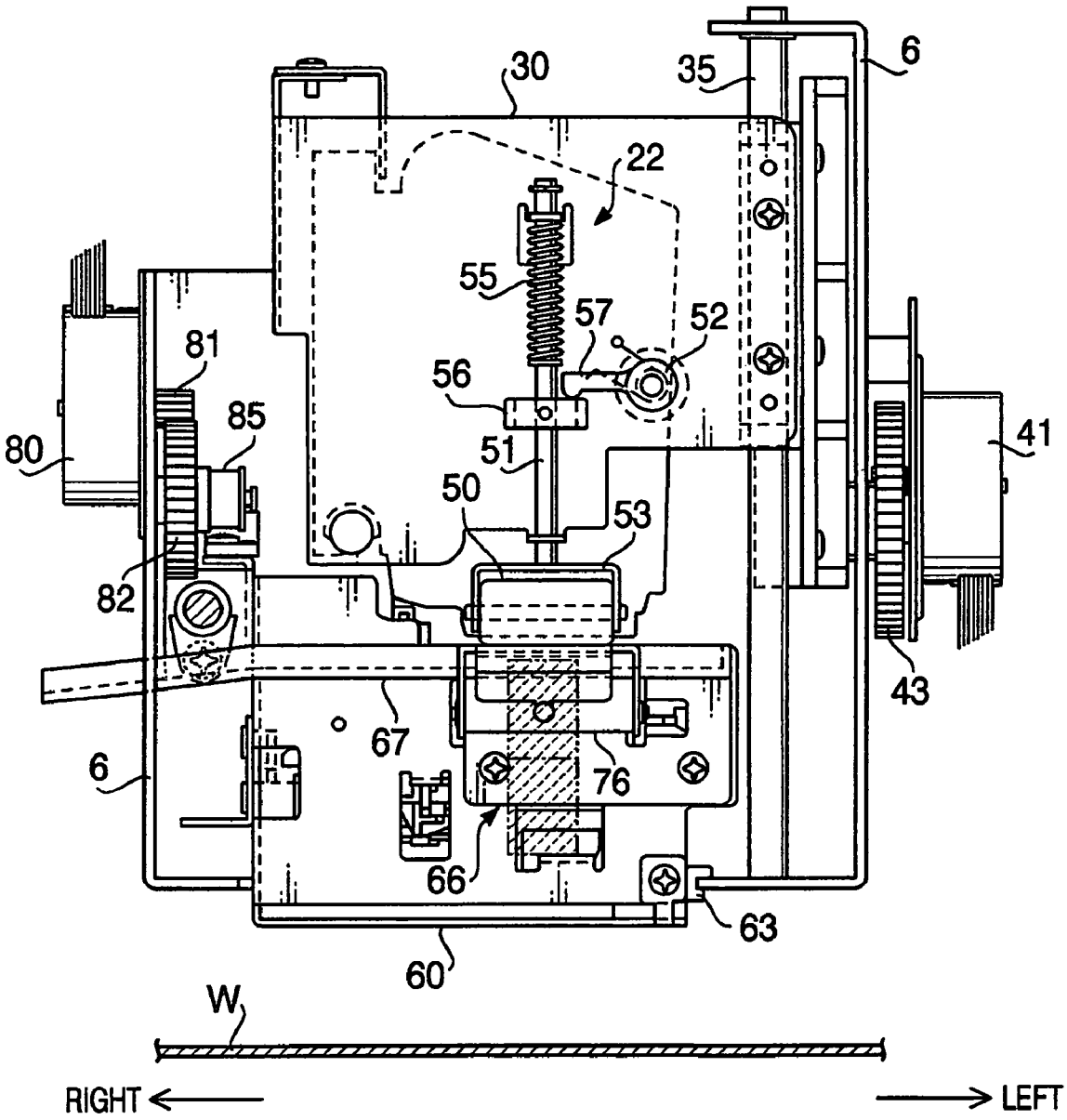
FIG. 9 is a rear view of the main body (corresponding to FIG. 5) during the flushing process according to aspects of the invention.

With the above configuration, when the head vertical driving motor 41 rotates clockwise/counterclockwise, the printing unit 30 (being guided by the pair of head guide shafts 35 and receiving the driving force of the head vertical driving motor 41 via the drive gear 42, the double gear 43 and the rack member 40) is moved upward/downward between a printing position (at the lower end) shown in FIG. 3 and an upper position shown in FIGS. 7-9.

Next, the fabric thickness detecting mechanism 22, which is attached to the printing unit 30 to be placed on a preceding side of the printing unit 30 in the printing direction "pd" (i.e. downstream side regarding the arrow "pd"), will be explained in detail. As shown in FIGS. 3-5, the fabric thickness detecting mechanism 22 includes a wide idle roller 50 which rotates freely while contacting the surface (print surface) of the fabric W, a sensor shaft 51 linked with the idle roller 50, and a potentiometer 52 which outputs a fabric thickness signal according to the vertical movement of the sensor shaft 51. The idle roller 50 has a width of approximately 1 inch, which is equal to the aforementioned print width of the print head 36.

As shown in FIG. 5, the sensor shaft 51 extending vertically is supported by supporting portions 30*a* and 30*b* (formed by bending upper and lower portions of the rear wall of the unit frame 30F) to be movable vertically. The idle roller 50, with its axis oriented in the X direction, is supported by a supporting member 53 (in a gate-like shape) at the lower end of the sensor shaft 51 to be rotatable around the axis in the X direction, that is, around a horizontal axis orthogonal to the printing direction.

A spring stop ring 54 is fixed on a middle portion of the sensor shaft 51 in the vertical direction and a spring 55 of small spring force is sandwiched between the spring stop ring 54 and the upper supporting portion 30*a*.

Being constantly biased downward by the elastic spring force of the spring 55, the idle roller 50 presses the surface of the fabric W (placed below) from above while being freely rotatable. Meanwhile, a contacting member 56 is also fixed on the middle portion of the sensor shaft 51 in the vertical direction, by which the sensor shaft 51 is prevented from rotating. The potentiometer 52 is fixed on a portion of the rear wall of the unit frame 30F corresponding to the lateral portion of the contacting member 56.

As shown in FIG. 5, a movable arm 57 linked with the drive shaft of the potentiometer 52 makes contact with the contacting member 56 from above. The movable arm 57 is constantly biased by a torsion coil spring 58 (see FIGS. 3 and 5) to push the contacting member 56 from above.

Therefore, when the fabric holding frame 10 moves in the frontward print direction "PD" during the printing by the print head 36, that is, when the unit frame 30F (of the printing unit 30 including the print head 36) moves in the rearward print direction "pd" relative to the fabric W held by the fabric holding frame 10, the idle roller 50 moves vertically depending on the thickness of the fabric W (i.e. depending on the height of the print surface of the fabric W), by which the sensor shaft 51 and the contacting member 56 is moved vertically to rotate the movable arm 57. According to the rotation angle of the movable arm 57, the fabric thickness signal representing the thickness of the fabric W is outputted by the potentiometer 52.

Figure 14:
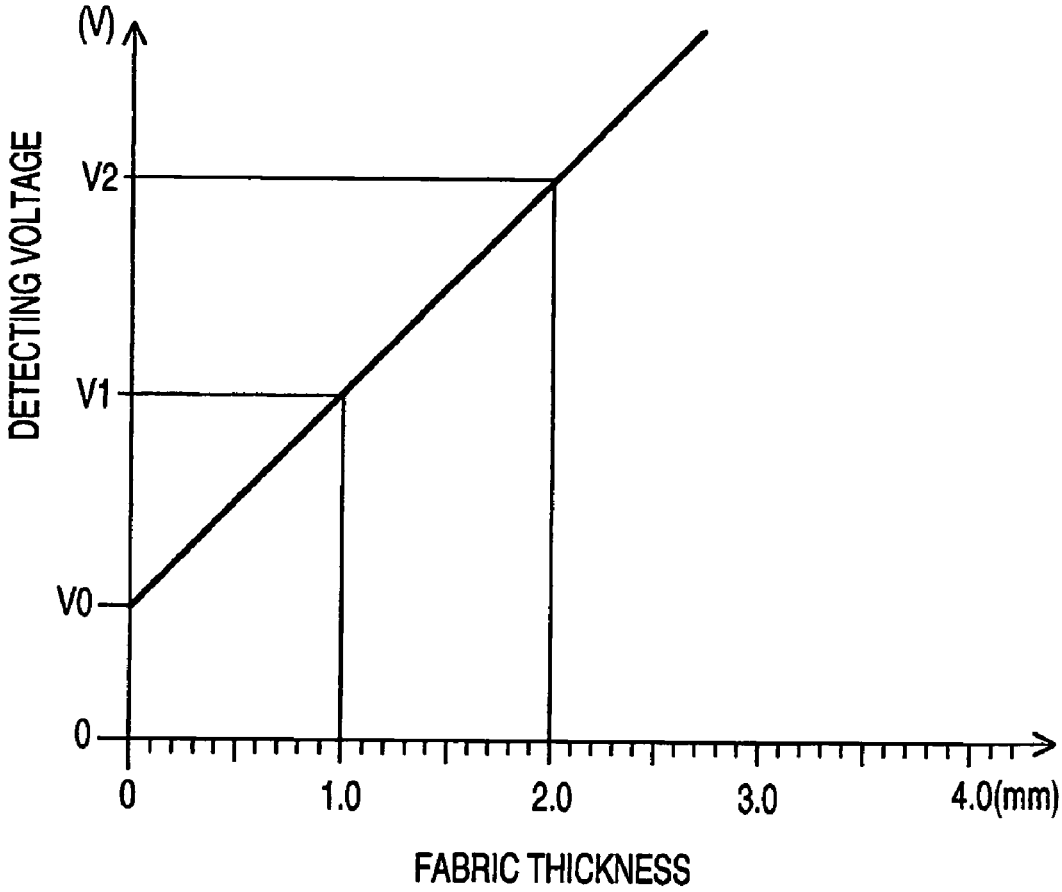
FIG. 14 is a graph showing an example of the relationship between fabric thickness and detecting voltage of a potentiometer of a fabric thickness detecting mechanism according to aspects of the invention.

An example of the fabric thickness signal outputted by the potentiometer 52 is shown in FIG. 14. In the example of FIG. 14, the voltage of the fabric thickness signal (detecting voltage) is "V0" when the fabric thickness is "0", "V1" when the fabric thickness is "1.0 mm", and "V2" when the fabric thickness is "2.0 mm".

Next, the maintenance mechanism 21 for executing a flushing process (during printing), a purge process (not during printing), etc. will be explained in detail. As shown in FIGS. 3 and 4, the maintenance mechanism 21 includes a maintenance unit 60 (having a capping mechanism 65, a purge mechanism 66 and a receiver tub member 67 for receiving waste ink) which is movable frontward and rearward inside the chassis 6 and a frontward/rearward driving mechanism 61 for driving the maintenance unit 60 frontward and rearward.

Figure 12:
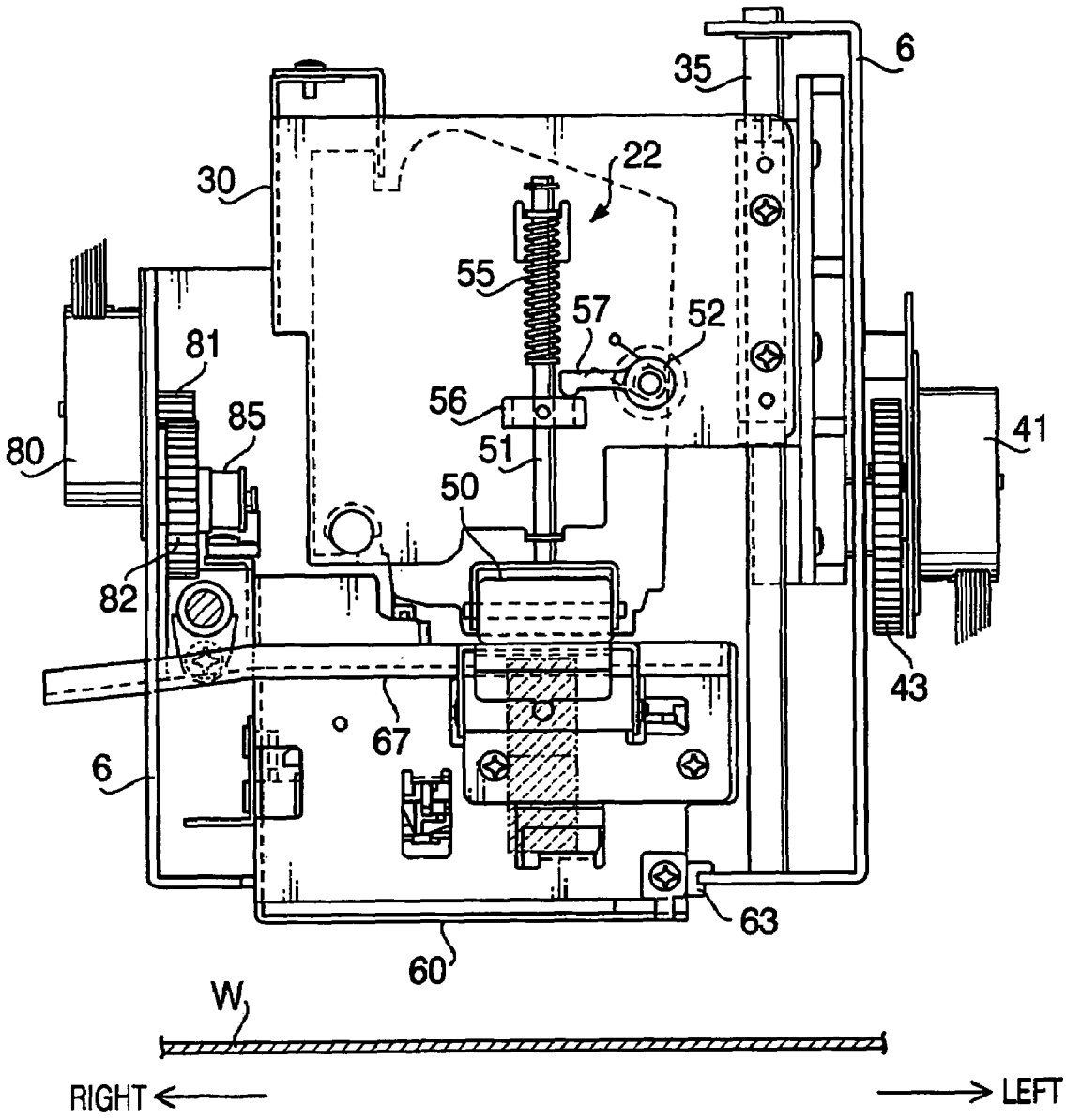
FIG. 12 is a rear view of the main body (corresponding to FIG. 5) during the purge process according to aspects of the invention.

First, the maintenance unit 60 in a box shape will be explained. As shown in FIG. 4, a maintenance guide shaft 62 extending in the Y direction (frontward/rearward) is placed in the rightmost portion of the chassis 6 with its both ends fixed to the chassis 6, and a unit frame 60F of the maintenance unit 60 is supported by the maintenance guide shaft 62 at its right end to be movable in the Y direction (frontward/rearward). Meanwhile, as shown in FIG. 12, an engaging member 63 fixed to the maintenance unit 60 is engaged with the lower end of the chassis 6, by which the maintenance unit 60 is support by the chassis 6 to be movable (slidable) in the Y direction (frontward/rearward) by the driving force of the frontward/rearward driving mechanism 61 (explained later).

The maintenance unit 60 includes the capping mechanism 65, the purge mechanism 66, the receiver tub member 67 for receiving ink discharged from the print head 36 during the flushing process, a covering mechanism 68 having a covering member 76 for covering the top of the receiver tub member 67 and thereby blocking the idle roller 50 from falling into the receiver tub member 67 during the purge process, etc., by which the flushing process, the purge process and a cap process are executed.

Figure 10:
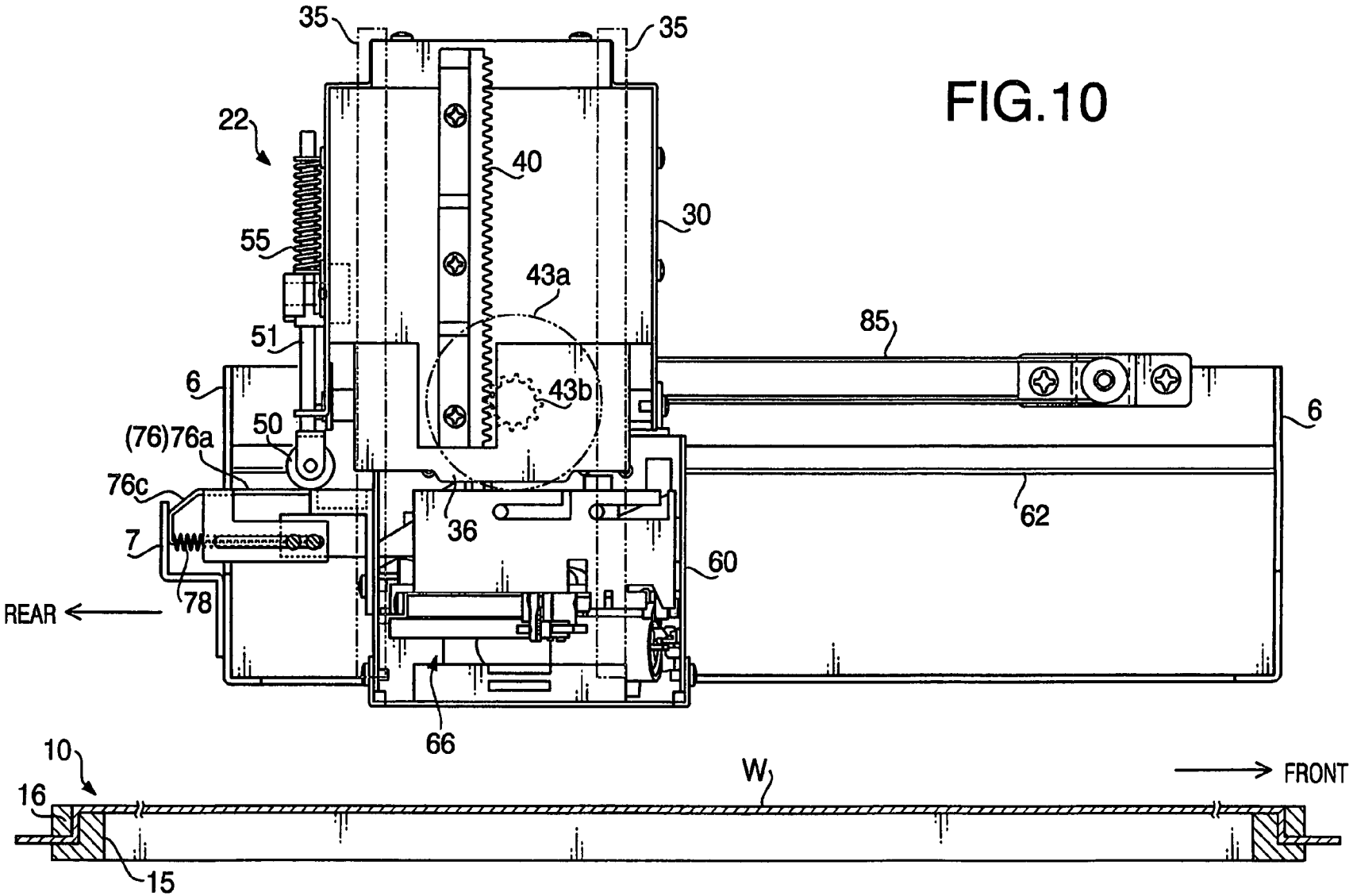
FIG. 10 is a left side view of the main body (corresponding to FIG. 3) during a purge process according to aspects of the invention.

The capping mechanism 65 will be explained briefly. The capping mechanism 65 has a pair of head caps 70 made of rubber, designed to be able to closely contact (cap) the head surface of the print head 36 (moved upward as shown in FIG. 10 when no printing is executed) from below in the vicinity of the top of the unit frame 60F of the maintenance unit 60. When the printer 1 executes no printing, a purge motor 100 (see FIG. 13) of the purge mechanism 66 (explained below) drives the head caps 70 upward to let the head caps 70 contact and cover (cap) the head surface from below, by which the drying of a lot of ink nozzles of the print head 36 is prevented.

The purge mechanism 66 will be explained briefly. The purge mechanism 66 includes the pair of head caps 70, a suction pump 102 (see FIG. 13), etc. When the head caps 70 have risen to the capping position as above, the suction pump 102 is activated to cause negative pressure inside the head caps 70 capping the head surface, by which a small amount of ink, bubbles, dregs, etc. remaining in each ink nozzle of the print head 36 are sucked out and fine printing condition is maintained (purge process).

The receiver tub member 67, as a tub extending in the X direction (rightward/leftward), is placed at the rear end of the unit frame 60F of the maintenance unit 60 (i.e. on the preceding side of the unit frame 60F in the printing direction "pd"). A left portion of the receiver tub member 67 is fixed to the rear wall of the unit frame 60F with screws. Ink-absorbing felt 67A (see FIGS. 4, 6 and 11) is spread all over the inner surface of the receiver tub member 67 to receive ink discharged from the ink nozzles in the flushing process.

Figure 6:
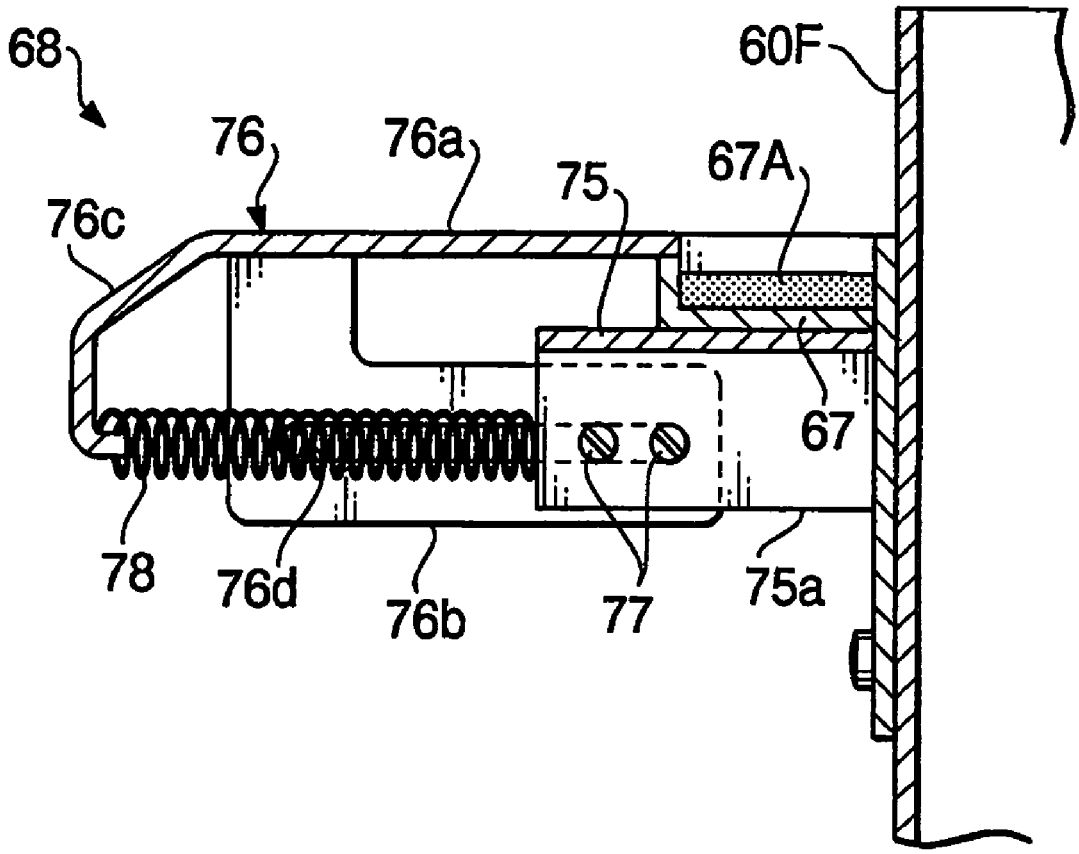
FIG. 6 is a vertical sectional view of a covering mechanism of the printer taken along the line F-F shown in FIG. 4.

Next, the covering mechanism 68 will be explained. FIG. 6 is a vertical sectional view of the covering mechanism 68 taken along the line F-F shown in FIG. 4. As shown in FIGS. 3, 4 and 6, the top surface of a supporting member 75 (in a gate-like shape when viewed from the front) is fixed to a portion of the under surface of the receiver tub member 67 corresponding to the idle roller 50. The supporting member 75 has a pair of supporting portions 75*a* bent downward on both sides of the supporting member 75. Meanwhile, the covering member 76 has a cover plate portion 76*a* (extending horizontally at the top of the covering member 76) and a pair of contacting wall portions 76*b* (bent downward on both sides of the cover plate portion 76*a*). At the rear end of the cover plate portion 76*a*, a slant guide surface 76*c* slanted rearward is formed.

With the above configuration, when the maintenance unit 60 moves rearward to a flushing position which will be explained later, the idle roller 50 is lifted by the slant guide surface 76*c* of the covering member 76. The aforementioned contacting wall portions 76*b* of the covering member 76 are in contact with the supporting portions 75*a* of the supporting member 75 respectively from outside. As shown in FIG. 6, each contacting wall portion 76*b* is provided with a slit 76*d* extending in the Y direction (frontward/rearward). Two shafts 77 are inserted through the slits 76*d* of the contacting wall portions 76*b* and through holes of the supporting portions 75*a*, and retaining rings are attached to the shafts 77 from outside, by which the covering member 76 is supported by the supporting member 75 (via the slits 76*d*) to be movable in the Y direction (frontward/rearward) relative to the supporting member 75.

A spring 78 is inserted between the rear wall of the covering member 76 and the rear wall of the supporting member 75. Therefore, the covering member 76 is constantly biased by the spring force of the spring 78 toward a rearmost position (i.e. an uncovering position for letting the top of the receiver tub member 67 be open).

On the other hand, when the maintenance unit 60 is moved rearward in the cap process or the purge process and the covering member 76 makes contact with a contact plate 7 attached to the rear end of the chassis 6, the covering member 76 moves frontward against the spring force of the spring 78 (see FIGS. 10 and 11) and reaches a covering position for covering the top of the receiver tub member 67 with the cover plate portion 76*a*.

Next, the frontward/rearward driving mechanism 61 will be explained. As shown in FIGS. 4 and 5, a frontward/rearward driving motor 80 is mounted on a rear end portion of the right side face of the chassis 6. A drive gear 81 is fixed on the drive shaft of the frontward/rearward driving motor 80, and a large-diameter driven gear 82 engaging with the drive gear 81 is rotatably supported by the chassis 6. The driven gear 82 is formed integrally with a drive pulley 83. As shown in FIGS. 3 and 4, a driven pulley 84 is rotatably supported by a front portion of the right side face of the chassis 6. A drive belt 85 composed of a timing belt is stretched across the drive pulley 83 and the driven pulley 84.

A portion of the unit frame 60F of the maintenance unit 60 is fixed to a portion of the drive belt 85 by use of fixing member 86. Therefore, by activating the frontward/rearward driving motor 80, the maintenance unit 60 (driven by the frontward/rearward driving motor 80 via the drive gear 81, the driven gear 82, the drive pulley 83 and the drive belt 85) can be moved between the standby position (frontward position shown in FIGS. 3 and 4) and the maintenance position (rearward position shown in FIGS. 10 and 11) via the flushing position (intermediate position show in FIGS. 7 and 8).

Next, a control system of the printer 1 will be explained referring to a block diagram of FIG. 13.

The main body 11 of the printer 1 includes the control unit 90 (having a CPU 91, a ROM 92, a RAM 93 and an input-output interface (I/O) 94), various operation switches 95 (such as a print start switch and a frame movement switch), the potentiometer 52, a head height detector 96 for detecting the height of the print head 36 (in order to set the height of the print head 36 a reference height (2 mm) higher than the print surface of the fabric W), a drive circuit 97 for driving the print head 36, a drive circuit 98 for driving the head vertical driving motor 41, a drive circuit 99 for driving the frontward/rearward driving motor 80, a drive circuit 101 for driving the purge motor 100, a drive circuit 103 for driving the suction pump 102, etc.

Meanwhile, the frame driving mechanism 12 includes a carriage position sensor 104 for detecting the X direction position and Y direction position of the Y carriage 13 (corresponding to the X direction position and Y direction position of the fabric holding frame 10), the X direction driving motor 105 for driving the fabric holding frame 10 (via the Y carriage 13) in the X direction, the Y direction driving motor 107 for driving the fabric holding frame 10 (via the Y carriage 13) in the Y direction, a drive circuit 106 for driving the X direction driving motor 105, a drive circuit 108 for driving the Y direction driving motor 107, etc.

In the following, the operation and effects of the printer 1 configured as above will be explained in detail.

Figure 15:
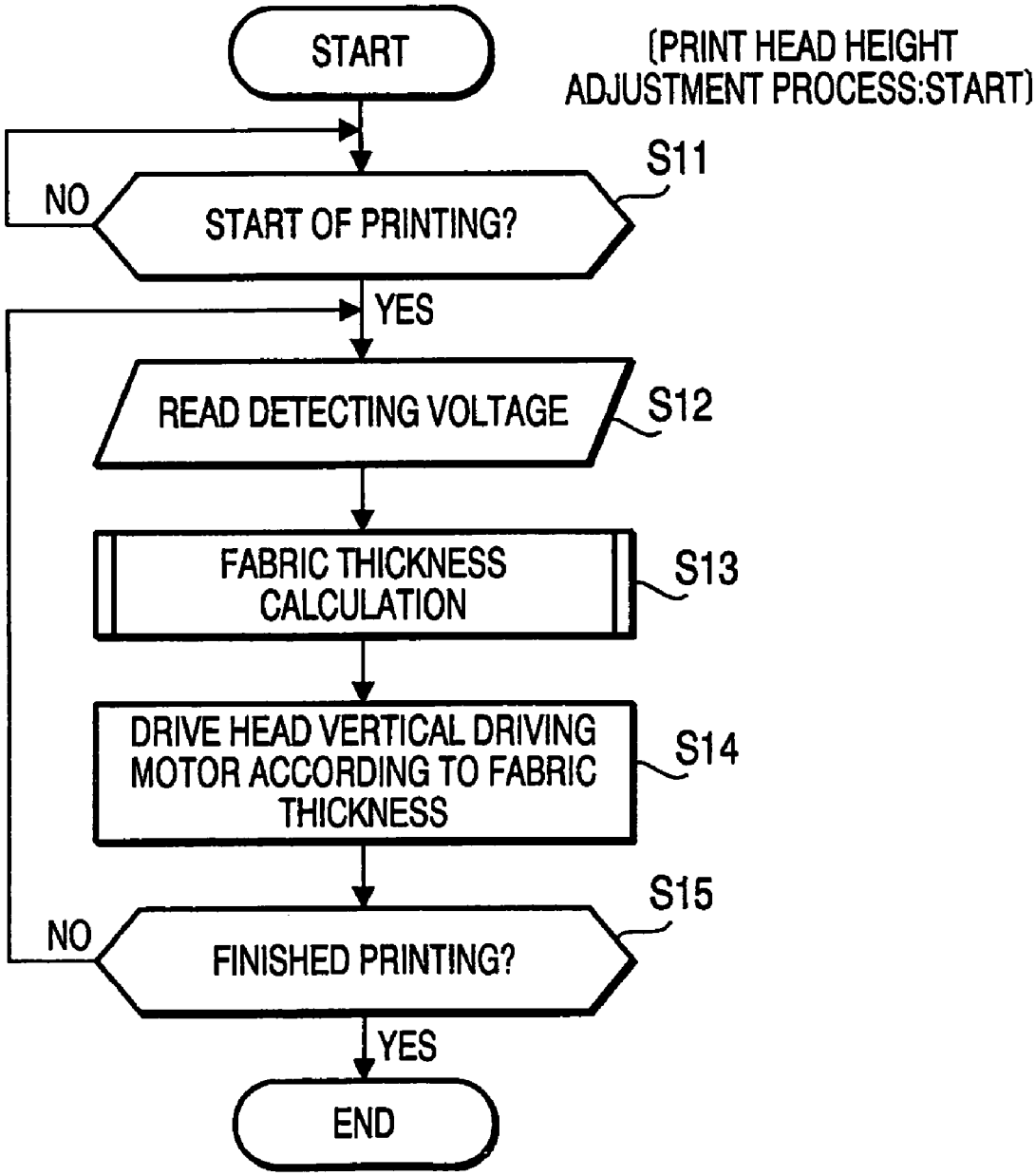
FIG. 15 is a flow chart showing a print head height adjustment process executed by the printer according to aspects of the invention.

When the printing is executed by the printing mechanism 20, the maintenance unit 60 is moved by the frontward/rearward driving motor 80 to the standby position (frontward position) as shown in FIGS. 3 and 4, and the printing unit 30 is moved by the head vertical driving motor 41 from the upper position to the printing position (lower position) and is stopped at a height that is the reference height higher than the height of the print surface of the fabric W (assumed to be "0" at this stage) based on the height of the print head 36 detected by the head height detector 96. When the fabric W to be printed on is set in the fabric holding frame 10 and the print start switch is pressed, a print head height adjustment process shown in FIG. 15 is executed along with a print control process (unshown).

The print control process is similar to the well-known print process executed by ordinary inkjet printers and thus detailed explanation thereof is omitted here. When the print head height adjustment process is started simultaneously with the print control process (S11: YES), the detecting voltage V of the potentiometer 52 is read out (S12) and a fabric thickness calculation is executed (S13). In the fabric thickness calculation (S13), the thickness of the fabric W (fabric thickness) is calculated based on the present detecting voltage V of the potentiometer 52 with respect to the voltage "V0" (detected when the fabric thickness is "0").

For example, the fabric thickness is determined to be approximately 1.0 mm when the detecting voltage is "V1", approximately 2.0 mm when the detecting voltage is "V2", etc. in the example of FIG. 14. Subsequently, the head vertical driving motor 41 is driven according to the calculated fabric thickness (S14). Specifically, when the fabric thickness is approximately 1.0 mm, the print head 36 is driven and raised by the head vertical driving motor 41 by approximately 1.0 mm compared to the case where the fabric thickness is "0". When the fabric thickness is approximately 2.0 mm, the print head 36 is driven and raised by the head vertical driving motor 41 by approximately 2.0 mm compared to the case where the fabric thickness is "0". By the height adjustment, a head gap HG between the print head 36 and the surface (print surface) of the fabric W is constantly adjusted and set at a prescribed distance (the reference height=approximately 2 mm).

Until the printing process is finished (S15: NO), the loop of the steps S12-S15 is executed repeatedly. When the flushing process is executed during this printing process, the printing is interrupted and the printing unit 30 is moved upward by the head vertical driving motor 41 to a prescribed maintenance height as explained above referring to FIGS. 7-9.

Subsequently, the maintenance unit 60 is moved by the frontward/rearward driving motor 80 to an unshown first flushing position (front flushing position) for letting the front nozzle arrays 36*c* and 36*d* face the receiver tub member 67 and a first flushing process is executed. Thereafter, the maintenance unit 60 is moved by the frontward/rearward driving motor 80 to an unshown second flushing position (rear flushing position) for letting the rear nozzle arrays 36*a* and 36*b* face the receiver tub member 67 (as shown in FIG. 8) and a second flushing process is executed.

While the idle roller 50 runs onto the slant guide surface 76*c* of the covering member 76 in the flushing process as shown in FIG. 7, the covering member 76 is at the uncovering position and thus the receiver tub member 67 is not covered by the covering member 76. When the flushing process is finished, the maintenance unit 60 is returned to the standby position by the frontward/rearward driving motor 80, the printing unit 30 is moved downward to a prescribed printing height, and the printing process is restarted. When the printing process is finished (S15: YES), the print head height adjustment process of FIG. 15 is ended.

Figure 11:
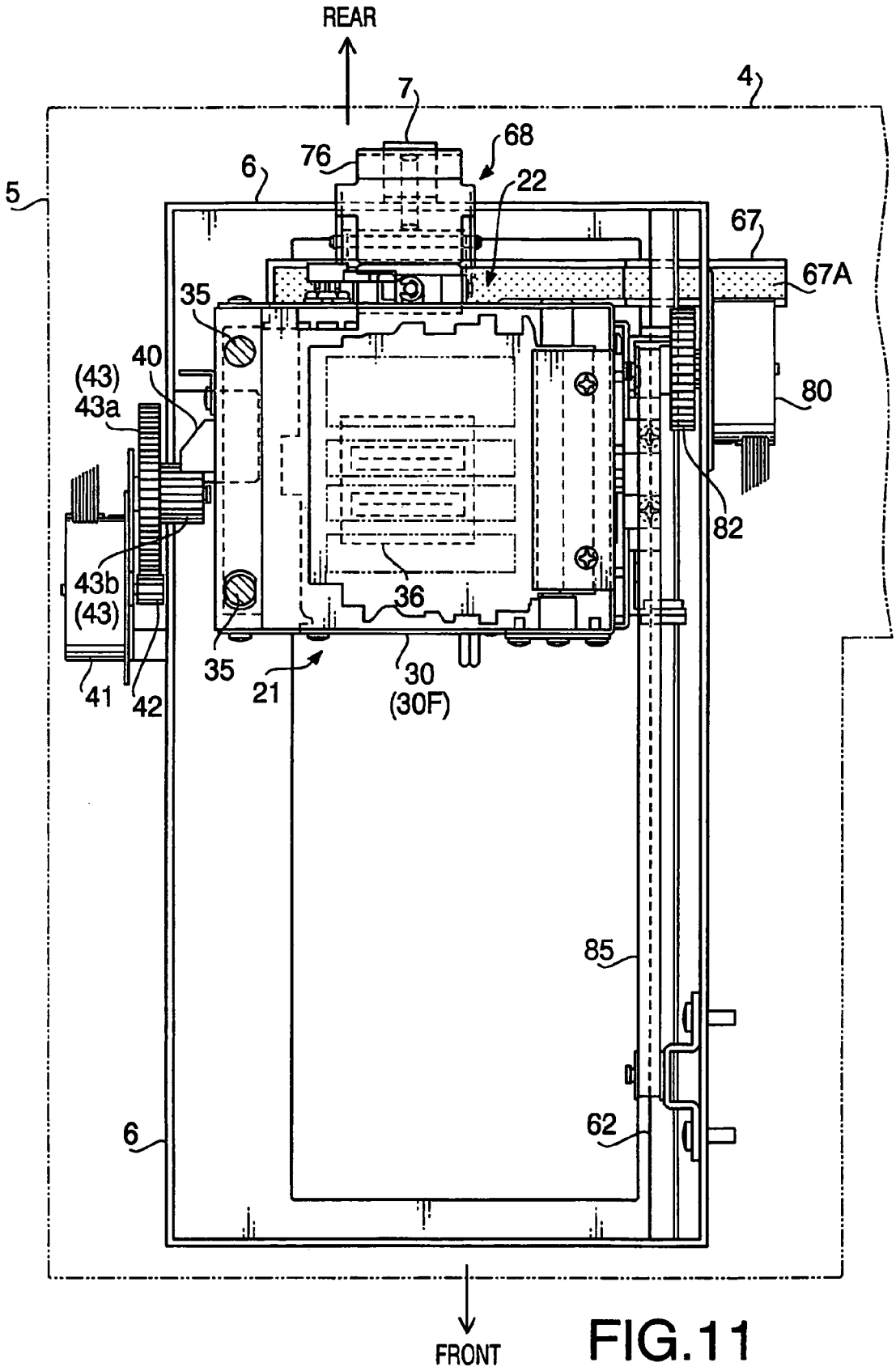
FIG. 11 is a plan view of the main body (corresponding to FIG. 4) during the purge process according to aspects of the invention.

Incidentally, when the purge process is executed after the printing process, the printing unit 30 is moved upward by the head vertical driving motor 41 to the prescribed maintenance height and the maintenance unit 60 is moved by the frontward/rearward driving motor 80 to the maintenance position (rearmost position) as shown in FIGS. 10-12.

In this case, when the maintenance unit 60 passes by the first and second flushing positions, the idle roller 50 runs onto the cover plate portion 76*a* of the covering member 76 via the slant guide surface 76*c*. Thereafter, the rear end of the covering member 76 makes contact with the contact plate 7 just before the maintenance unit 60 reaches the maintenance position, by which the cover plate portion 76*a* moves frontward to the covering position for covering the top of the receiver tub member 67 and thereafter the idle roller 50 (on the covering member 76) moves to the top of the receiver tub member 67 as shown in FIGS. 10-12. By the above operation, the idle roller 50 is prevented from falling into the receiver tub member 67.

Since the printer 1 of this embodiment is provided with the vertical driving unit 31, the fabric thickness detecting mechanism 22 and the control unit 90 as explained above, the height of the print surface of the fabric W (corresponding to the height of the idle roller 50) can be detected by the fabric thickness detecting mechanism 22 of the so-called contact type (having the idle roller 50 contacting the print surface of the fabric W) and the height of the printing unit 30 can be controlled and adjusted according to the detected height of the print surface of the fabric W. Therefore, a desired pattern, design, etc. can be printed on the fabric W finely and precisely by constantly keeping the head gap HG at the prescribed distance, even when the fabric W has frayed parts, fuzzy parts or lint thereon and irrespective of the material and color of the fabric W.

The fabric thickness detecting mechanism 22 in this embodiment employs no optical sensor for the detection of the fabric thickness, and thus the fabric thickness detecting mechanism 22 can be prepared at a low price. Further, the fabric thickness detecting mechanism 22, free from the ill effects of ink mist during printing, is capable of correctly detecting the height of the print surface of the fabric W, realizing high reliability of the head gap setting.

The idle roller 50 is attached to the unit frame 30F of the printing unit 30 to be placed on the preceding side of the printing unit 30 (print head 36) in the printing direction, by which the idle roller 50 is prevented from being smeared with the ink printed on the fabric W, and ink stains on the fabric W, that can be caused by the contact with the idle roller 50, is eliminated securely.

The width of the contact face of the idle roller 50 making contact with the fabric W is set equal to the print width of the nozzle arrays 36*a*-36*d* of the print head 36, by which any convex portion of the fabric W within the print width can be detected with reliability.

The idle roller 50 is designed to be rotatable around a horizontal axis orthogonal to the printing direction. Therefore, even when the fabric W has embroidery, needlework, applique, etc. thereon and the height of the print surface of the fabric W changes during the printing process which is executed while feeding the fabric W (that is, even when there are obstacles such as gaps and level differences), the idle roller 50 can easily climb over any obstacle while rotating around the horizontal axis, by which the height of the print surface of the fabric W can be detected correctly and reliably.

The fabric thickness detecting mechanism 22 is mainly composed of the sensor shaft 51 being vertically movable relative to the unit frame 30F and having the idle roller 50 at one end, the spring 55 for biasing the sensor shaft 51 toward the fabric W, and the potentiometer 52 for detecting the displacement (movement) of the sensor shaft 51 moving upward against the biasing force of the spring 55. Therefore, the fabric thickness detecting mechanism 22 can be manufactured at a low price while realizing compact design and weight reduction.

The printer 1 is provided with the receiver tub member 67 for receiving waste ink during the flushing of the print head 36 and the covering member 76 capable of covering the top of the receiver tub member 67. Therefore, the ink discharged from the print head 36 for the flushing can be received with the receiver tub member 67 and collected therein, and it is possible to let the covering member 76 cover the top of the receiver tub member 67 and block the idle roller 50 from falling into the receiver tub member 67 even when the idle roller 50 passes over the receiver tub member 67, by which the idle roller 50 is securely prevented from being smeared with ink.

The covering member 76 is placed at the uncovering position (for letting the top of the receiver tub member 67 be open) in the flushing process, while being placed at the covering position (for covering the top of the receiver tub member 67) in the purge process for purging the print head 36. Therefore, even when the covering member 76 has been placed at the covering position for the purge process, the covering member 76 is necessarily moved to the uncovering position when the flushing process (discharging ink from ink nozzles onto the receiver tub member 67) is executed, by which the flushing process can be carried out without smearing the covering member 76 with ink.

In the purge process, the idle roller 50 of the fabric thickness detecting mechanism 22 is placed on the covering member 76. Therefore, the idle roller 50 is blocked from falling into and getting stuck in the receiver tub member 67 in the purge process (purging of the print head 36), by which the idle roller 50 is securely prevented from being smeared with ink.

The slant guide surface 76*c* for guiding the idle roller 50 is formed at an end of the covering member 76. Therefore, even when the covering member 76 has a height greater than that of the idle roller 50, the idle roller 50, guided by the slant guide surface 76*c*, can easily climb up to the top of the covering member 76 without fail.

The printer 1 is provided with the maintenance unit 60 including the purge mechanism 66 for executing maintenance such as the purge process. The maintenance unit 60 is designed to be switchable between the standby position (to the rear of the printing unit 30 in the printing direction "pd") and the maintenance position under the printing unit 30 which has been switched to the upper position, and the receiver tub member 67 and the covering member 76 are fixed to the maintenance unit 60 to be placed on the preceding side of the maintenance unit 60 in the printing direction "pd". Therefore, the maintenance unit 60 placed at the standby position during the printing by the print head 36 can move to the maintenance position under the printing unit 30 switched to the upper position in cases of maintenance (e.g. purge process) and thereby execute a variety of maintenance such as the purge process and the cap process.

When the maintenance unit 60 is placed at the maintenance position as above, the receiver tub member 67 fixed to the maintenance unit 60 is covered by the covering member 76, by which the idle roller 50 supported by the unit frame 30F of the printing unit 30 is securely prevented from falling into and getting stuck in the receiver tub member 67.

In the following, some modifications possible to the above embodiment will be described.

The roller width of the idle roller 50 (i.e. the width of the contact face of the idle roller 50 making contact with the fabric W) may also be set smaller than the print width of the print head 36. In this case, the idle roller 50 is prevented from being smeared with ink that has been printed on the fabric W in the previous print cycle even when overlapped printing (in which the print width in a print cycle overlaps with that in the previous print cycle) is executed, by which ink stains on the fabric W, that can be caused by the contact with the idle roller 50, can be eliminated with reliability.

The timing for moving the printing unit 30 upward/downward in response to the change in the thickness of the fabric W (the change in the height of the idle roller 50) may be delayed for a proper time period depending on the printing speed, that is, the speed of movement of the fabric holding frame 10.

The covering member 76 (e.g. cover plate portion 76*a*) may also be formed in a width smaller than the roller width of the idle roller 50 or in a linear or thin belt-like shape. Even with such a covering member 76, the idle roller 50 is securely prevented from falling into and getting stuck in the receiver tub member 67.

While a description has been given above of a preferred embodiment in accordance with the present invention, the present invention is not to be restricted by the particular illustrative embodiment and a variety of modifications, design changes, etc. are possible without departing from the scope and spirit of the present invention described in the appended claims.

What is claimed is:

1. A printer comprising:

an inkjet head;

a head supporting body which supports the inkjet head;

a moving unit which moves the head supporting body or a fabric holding body, holding fabric to be printed on by the inkjet head, relative to each other in two orthogonal directions;

a supporting body moving unit which moves the head supporting body so as to let the inkjet head move toward and away from the fabric;

a fabric thickness detecting unit which includes a contactor, being attached to the head supporting body to be placed on a preceding side of the head supporting body in a printing direction of the inkjet head and making contact with a print surface of the fabric held by the fabric holding body, and detects height of the print surface of the fabric based on a position of the contactor;

a drive control unit which executes drive control of the supporting body moving unit according to the height of the print surface of the fabric detected by the fabric thickness detecting unit;

a receiver tub member which receives ink during flushing of the inkjet head; and a covering member capable of covering the top of the receiver tub member;

wherein the covering member is placed at an uncovering position for letting the top of the receiver tub member be open when the flushing of the inkjet head is executed, while being placed at a covering position for covering the top of the receiver tub member when purging of the inkjet head is executed.

2. The printer according to claim 1, wherein width of a contact face of the contactor making contact with the fabric is set equal to print width of nozzle arrays of the inkjet head.

3. The printer according to claim 1, wherein width of a contact face of the contactor making contact with the fabric is set smaller than print width of nozzle arrays of the inkjet head.

4. The printer according to claim 1, wherein the contactor is implemented by an idle roller which is rotatable around a horizontal axis orthogonal to the printing direction.

5. The printer according to claim 1, wherein the fabric thickness detecting unit includes:

a sensor shaft being vertically movable relative to the head supporting body and having the contactor at one end;

an elastic body which biases the sensor shaft toward the fabric; and a displacement detecting unit which detects displacement of the sensor shaft moving upward against the biasing force of the elastic body.

6. The printer according to claim 5, wherein the displacement detecting unit is implemented by a potentiometer.

7. The printer according to claim 1, further comprising an ink-absorbing member which is placed on an inner surface of the receiver tub member.

8. The printer according to claim 1, further comprising:

a maintenance unit linked with the covering member and including a purge mechanism executing the purging of the inkjet head;

a biasing member which biases the covering member toward the uncovering position; and a contact member which makes contact with an end of the covering member as the maintenance unit is moved toward a position for the purging of the inkjet head and thereby pushes the covering member toward the covering position against the biasing force of the biasing unit.

9. The printer according to claim 8, wherein the contactor of the fabric thickness detecting unit is placed on the covering member when the purging of the inkjet head is executed.

10. The printer according to claim 9, wherein a slant guide surface for guiding the contactor is formed at an end of the covering member.

11. The printer according to claim 8, further comprising a maintenance unit which includes a purge mechanism executing purging of the inkjet head, wherein:

the maintenance unit is configured to be switchable between a standby position to the rear of the head supporting body in the printing direction and a maintenance position under the head supporting body which has been switched to an upper position, and the receiver tub member and the covering member are fixed to the maintenance unit to be placed on the preceding side of the maintenance unit in the printing direction.

12. The printer according to claim 1, wherein the drive control unit executes the drive control of the supporting body moving unit according to the height of the print surface of the fabric detected by the fabric thickness detecting unit a prescribed time period after detection of the fabric thickness.

13. The printer according to claim 12, wherein the prescribed time period is determined according to speed of movement of the fabric holding body relative to the contactor of the fabric thickness detecting unit in the printing direction.

* * * * *